US006163905A

United States Patent [19]

Noldus-Nilsen

[11] Patent Number: 6,163,905

[45] Date of Patent: Dec. 26, 2000

[54] SUPPORTING ARTICLE

[75] Inventor: Morten Noldus-Nilsen, Rungsted Kyst, Denmark

[73] Assignee: Danestyle Leisure Accessories A/S, Denmark, Denmark

[21] Appl. No.: 09/194,198

[22] PCT Filed: May 22, 1998

[86] PCT No.: PCT/DK97/00234

§ 371 Date: Nov. 20, 1998

§ 102(e) Date: Nov. 20, 1998

[87] PCT Pub. No.: WO97/43933

PCT Pub. Date: Nov. 27, 1997

[30] Foreign Application Priority Data

May 23, 1996 [DK] Denmark ..... 9600179

[51] Int. Cl.[7] ..... A47C 27/08

[52] U.S. Cl. ..... 5/655.3; 5/654; 5/706

[58] Field of Search ..... 5/636, 644, 655.3, 5/654, 706, 417, 420, 655, 424, 425, 946

[56] References Cited

U.S. PATENT DOCUMENTS

| | | | |
|---|---|---|---|
| 4,181,990 | 1/1980 | Santo . | |
| 4,905,332 | 3/1990 | Wang | 5/655.3 |
| 5,206,964 | 5/1993 | Wilson | 5/417 |
| 5,813,066 | 9/1998 | Gebhard et al. | 5/424 |

FOREIGN PATENT DOCUMENTS

| | | |
|---|---|---|
| 0094985A1 | 11/1983 | European Pat. Off. . |
| 1-0288047 | 10/1988 | European Pat. Off. . |
| 766794 | 7/1934 | France . |
| 1-2430213 | 1/1976 | Germany . |

*Primary Examiner*—Terry Lee Melius
*Assistant Examiner*—Fredrick Conley
*Attorney, Agent, or Firm*—Birch, Stewart, Kilasch & Birch LLP

[57] ABSTRACT

A supporting article (1;12) for comforting support of body parts and made of at least two layers (2;15) of web material welded together, which defines at least one compartment. The at least one compartment is made as an air channel (3;14) extending by a greater part of the periphery (4;15) of the article and is crossed by a valve means (5;16). Furthermore, the air channel defines a central area (6;17) of intermediary material. Hereby, a particular comforting support is achieved, which secures a stable positioning of the head or parts of a body.

7 Claims, 7 Drawing Sheets

SUPPORTING ARTICLE

This application is the national phase under 35 U.S.C. §371 of prior PCT International Application No. PCT/DK97/00234 which has an International filing date of May 22, 1997 which designated the United States of America, the entire contents of which are hereby incorporated by reference.

The novel invention relates to a supporting article for comforting support of one or more parts of a body and which is made of at least two layers of material welded together, which defines at least one compartment.

Supporting articles for support of parts of a body are known, such as support of the head in a resting position or the body in a lying position.

These known supporting articles are also either provided with many separate discrete air chambers or just one chamber which has a substantially similar cross section area along its entire extension.

The known supporting articles often involve an unsatisfactory support without the desired high comfort.

The supporting article for the comforting support of parts of a body according to the present invention is characterised in that the at least one compartment is made as an air channel extending by a greater part of the periphery of the article and is closed by a valve means and also defines a central area of intermediary material.

By this, an especially comforting support is provided which ensures a stable positioning of the head or supported parts of a body.

In the present context, the term "a greater part of the periphery" means that the channel extends by more than 50% of the periphery of the supporting article when the air channel is empty, and may extend up to 99,9% of the periphery whereby the two ends of the air channel almost meet.

The supporting article may be of various geometric shapes in plan view, e.g. as may be seen in FIG. 1 and FIG. 4. When the supporting article has four more or less well-defined sides, the air channel will typically extend along approximately 3 of the 4 sides of the supporting article, such as from 55% to 90% of the periphery.

Depending on the shape of the articles the air channel may extend from 60 to 80%, such as 65 to 75%.

An especially good and secure support is obtained when the air channel extending by a greater part of the periphery of the article is designed with different cross sections along the periphery of the article.

It has proved especially appropriate that the cross section area of the said air channel is smallest in parts where the channel alters direction thereby providing the supporting article with especially stable edge areas in between the alteration of direction of the channel.

According to the invention the extensions of the air channel on opposite sides of the central area may be designed with similar cross section forms.

By this, the best possible support of a head in a resting position is provided as well as a particular good positioning of parts of the body within the central area.

Especially, a particular good support for the head is obtained when the rest of the air channel connecting the parts of the air channel at the opposite sides of the central area having the similar cross section forms, is designed with a substantially smaller cross section area than at the said similar cross section areas.

The ratio of this substantially smaller cross section area to the similar cross section areas may be from 1:100 to 1:1,1, such as from 1:50 or 1:20 to 1:2, more preferably from 1:10 to 1:3.

The ratios of the parts where the channel alters direction to the rest of the channel may be from 1:100 to 1:1, preferably from 1:50 to 1:1, more preferably from 1:20 to 1:1.

According to the invention, the central area may further comprise a compartment. Furthermore, the compartment of the central area may be filled with resilient material, preferably foam material, so that the support as well as the comfort is most satisfactory.

By a particularly appropriate embodiment of the invention the resilient material in the compartment in the central area may be in a compressed state, and the web material defining said central compartment may be provided with an opening which is sealed with a fixed cover.

When the novel support is going to be used all that has to be done is removing the cover, such that the opening is exposed, and the air may enter into the foam material via the opening during expansion of the foam material. The cover over the opening is preferably adhesive.

Finally, it must be said that the compartment of the central area may also be constructed as an air chamber provided with a valve means.

The web material used in the present invention may be any kind of material, such as plastic material, suitable for being welded by heat-bonding, ultra sound and/or high frequency welding. The web material is furthermore suitable as walls in air chambers, i.e. the material is substantially or totally airtight.

The invention is explained in detail below referring to the especially preferred embodiments and the drawings and the photo, wherein.

Figure 1:
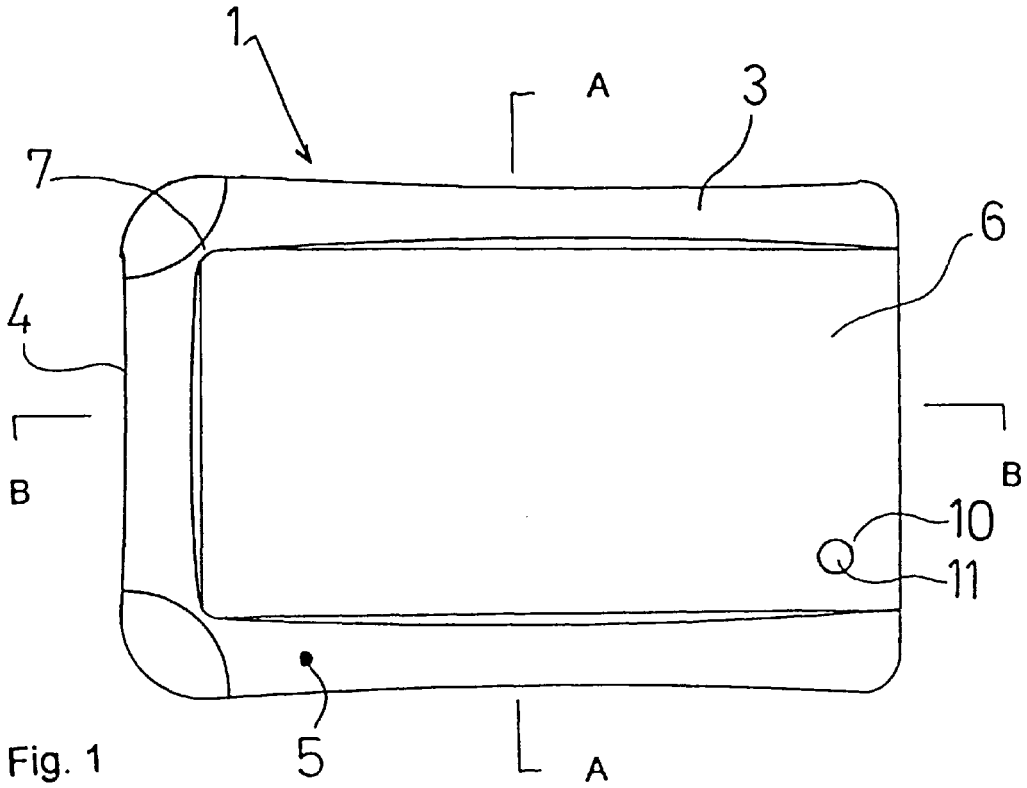
FIG. 1 shows a supporting article for support of parts of a body

In FIG. 1 the shown supporting article 1 for support of parts of a body according to the present invention is made of at least two layers 2, of web material welded together, and comprises an air channel 3 extending by a greater part of the periphery 4 of the article and is closed by a valve means 5 and also defines a central area 6 of intermediary material.

Preferably, the valve means 5 is of a known type for blowing in air and subsequent closing. Such as is known from air beds and beach balls.

The air channel 3 has the smallest cross section area in parts, where the channel alters its direction 7, whereby the supporting article is given particularly stable edge areas in between the alterations of direction of the channel.

At its extensions at opposite sides of the central area 6, the air channel 3 is designed with similar cross section forms 8.

Figure 2:
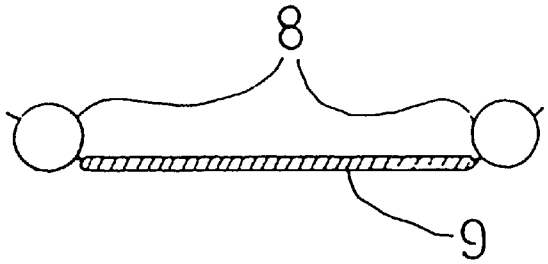
FIGS. 2–3 show section A—A and B—B, respectively, through the supporting article shown in FIG. 1.
Figure 3:
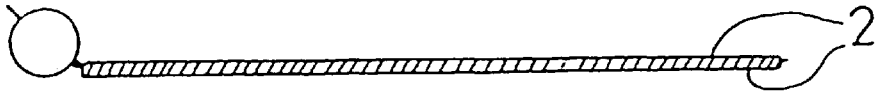
Figure 4:
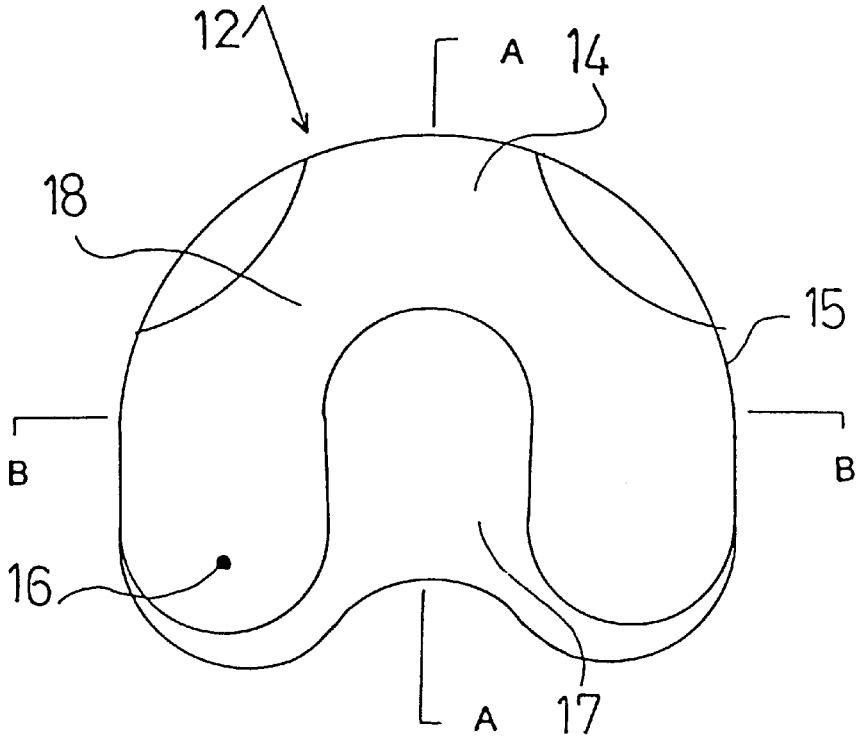
FIG. 4 shows a supporting article for support of the head.
Figure 5:
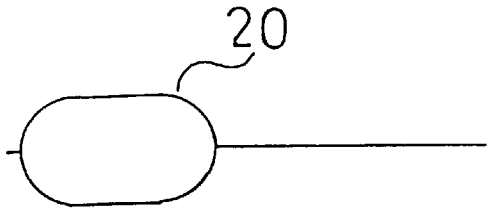
FIGS. 5–6 show section A—A and B—B, respectively, through the supporting article shown in FIG. 4.
Figure 6:
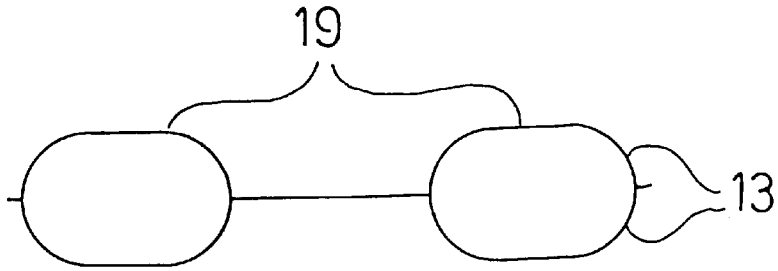
Figure 7:
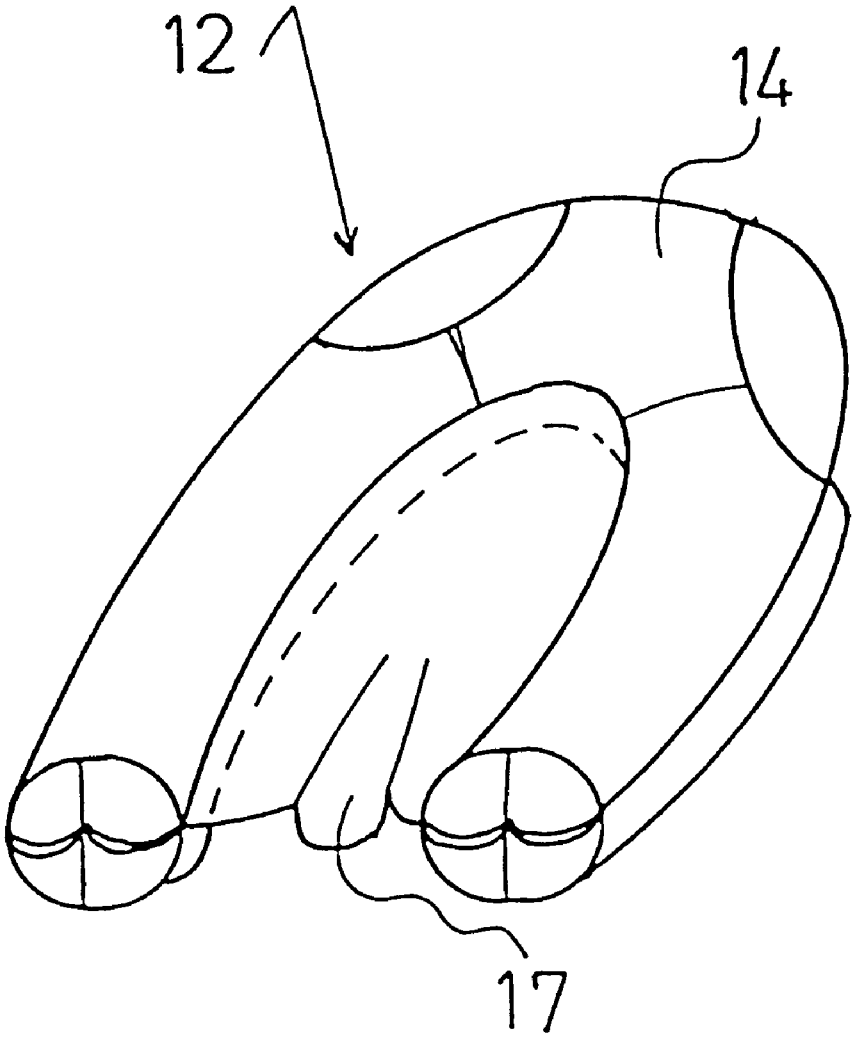
FIG. 7 shows in perspective view a supporting article for support of the head.
Figure 8A:
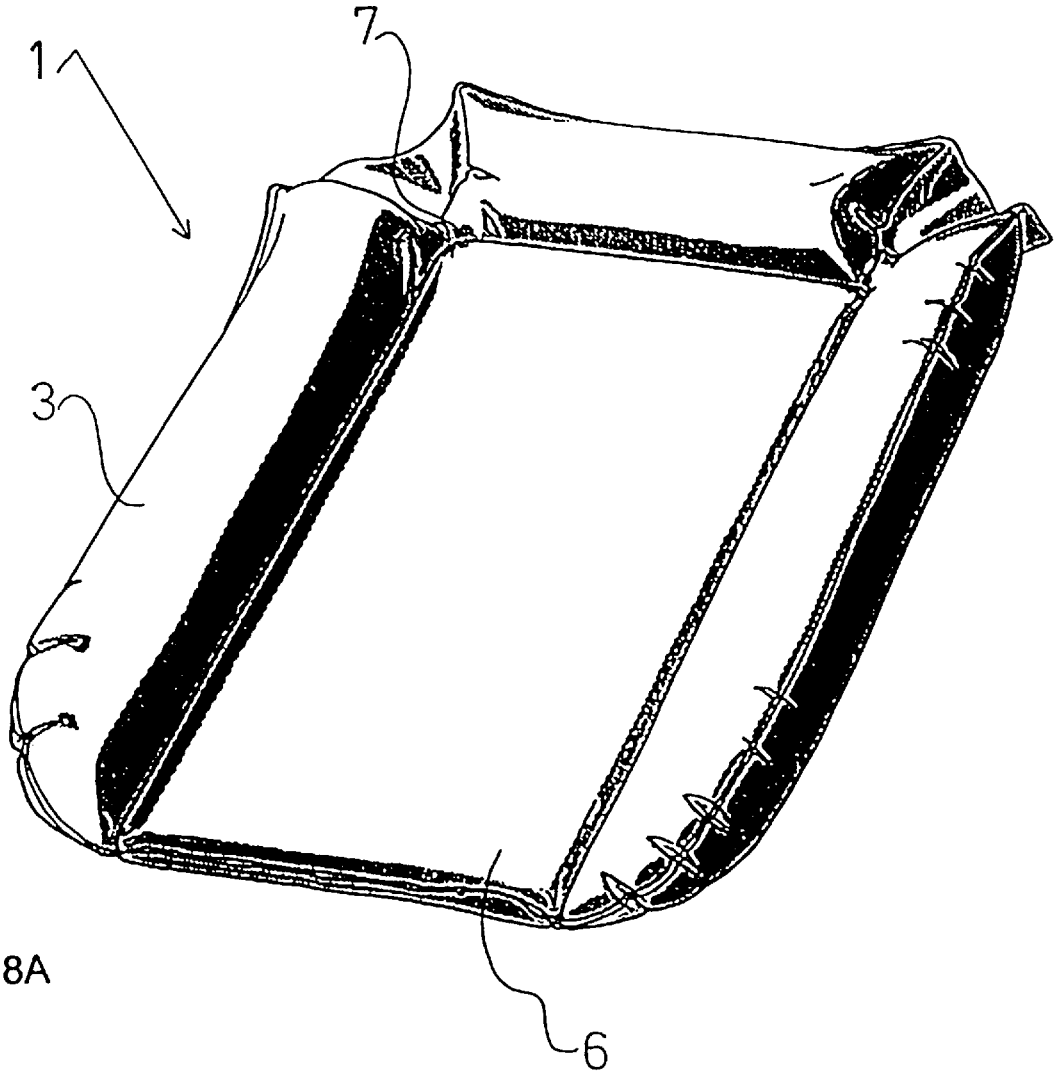
FIG. 8A is a plan view in perspective of a supporting article for support of parts of a body or in case of a baby, a whole body.
Figure 8B:
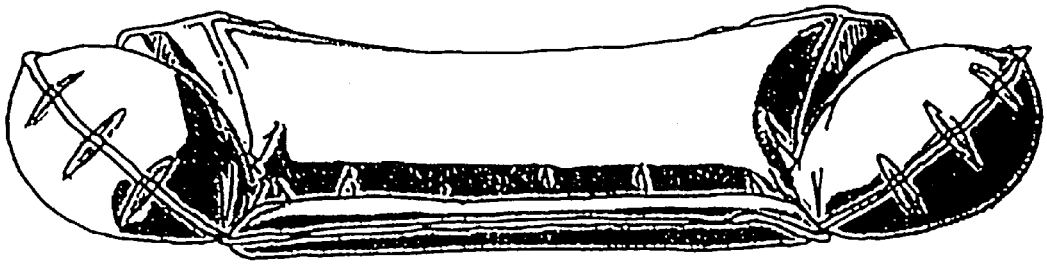
FIG. 8B is a end view of the article of FIG. 8A.
Figure 8C:
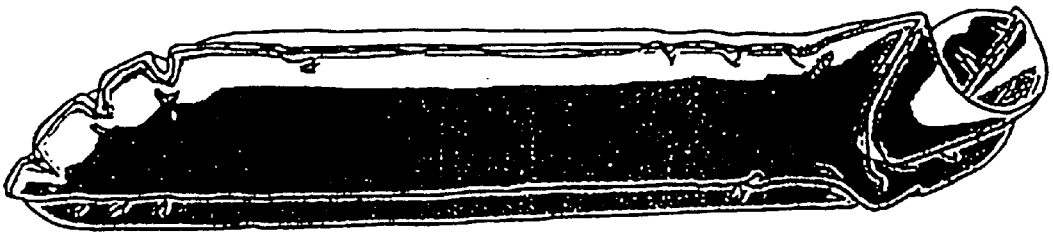
FIG. 8C is an side view of the article of FIG. 8A.
Figure 9A:
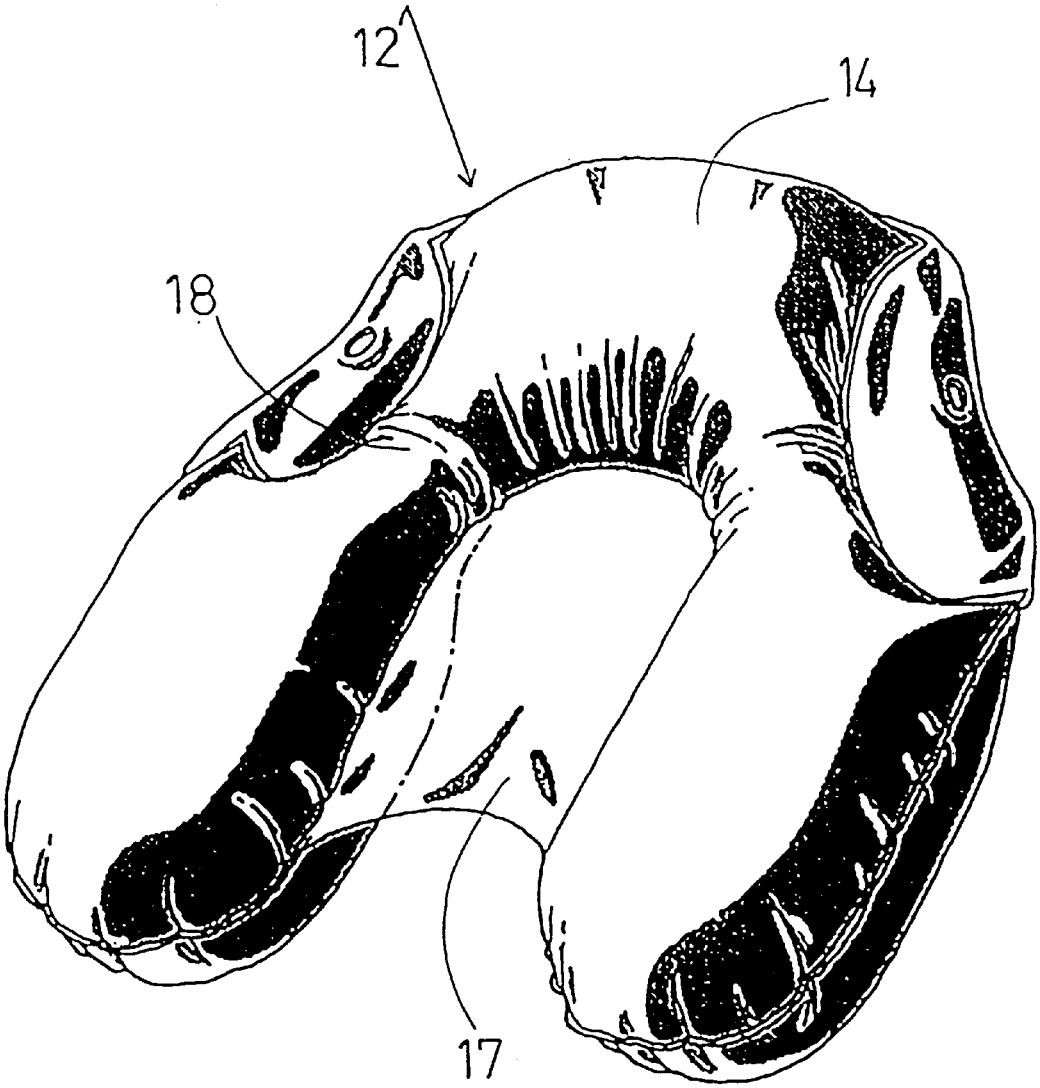
FIG. 9A is a plan view in perspective of a supporting article for support of the head.
Figure 9B:
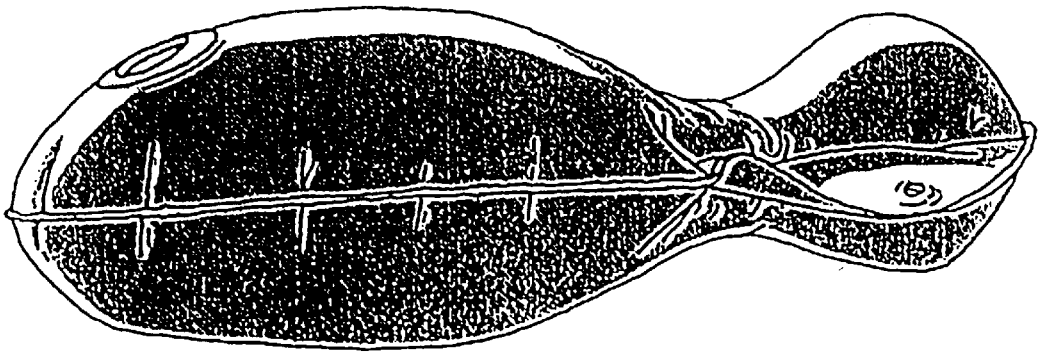
FIG. 9B is a side view of the article of FIG. 9A.
Figure 9C:
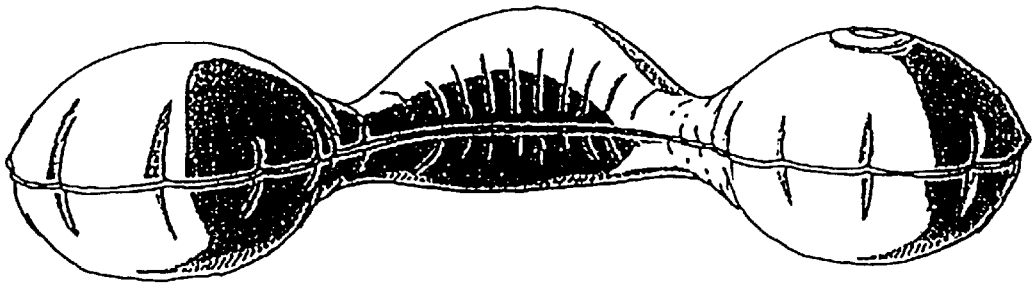
FIG. 9C is an end view of the article of FIG. 9A.

In a first embodiment shown in FIGS. 1–3, the central area 6 comprises a compartment 9.

The compartment 9 is filled with resilient material, preferably foam material.

In a particularly appropriate embodiment according to the invention the resilient material in the compartment 9 of central area 6 may be in the compressed state, and the web material defining said central compartment 9 may be provided with an opening 10, which is sealed with a fixed cover 11.

When the novel supporting article 1 is to be used the cover 11 is simply removed so that the opening 10 is exposed and the air may enter into the foam material via the opening 10 during expansion of the foam material. The cover 11 is preferably adhered over the opening 10.

Finally, the compartment 9 of the central area 6 may also be an air chamber provided with a traditional known valve means.

According to another embodiment shown in FIGS. 4–7 the supporting article 12 for support of the head is made of at least to layers 13 of web material welded together, and comprising an air channel 14 extending by a greater part of the periphery 15 of the article and is closed by a valve means 16 and also defines a central area 17 of intermediary material.

The air channel 14 has the smallest cross section area in parts, where the channel alters its direction 18, whereby the supporting article is given particular stable edge areas in between the alterations of direction of the channel. In these edge areas, a projecting flap of material welded together is often left, which is a further stabiliser.

According to the invention at its extensions on opposite sides of the central area 17, the air channel 14 is designed with similar cross section forms 19. Hereby the best possible support for the head is provided.

A particular good support for the head is achieved when the rest of the air channel 14 connecting the extensions of the air channel at the opposite sides of the central area 17 having the similar cross section forms 19 is made with a substantially smaller cross section area 20 than said similar cross section forms 19.

The air channel 14 extending by a greater part of the periphery of the article 15 is made with different cross section areas 19; 20 at the extension along the periphery 15 of the article.

What is claimed is:

1. A supporting article for comforting support of body parts which comprises at least two layers of web material welded together, which defines at least one compartment, and an air channel, said air channel having extensions extending around a greater part of a periphery of the article, said air channel being closed by a valve means and also defining a central area within the article, the air channel with extensions extending around a greater part of the periphery of the article is made with different cross section areas at its extension along the periphery of the article, and the air channel having the smallest cross section area in parts where the channel alters its direction.

2. The supporting article according to claim 1, wherein the air channel at its extensions on opposite sides of the central area comprises similar cross section forms.

3. The supporting article according to claim 2, wherein a remainder of the air channel connecting the extension of the air channel at the opposite sides of the central area with the similar cross section forms, is made with a substantially smaller cross section area than the said similar cross section areas.

4. The supporting article according to claim 3, wherein the central area comprises a compartment.

5. The supporting article according to claim 4, wherein the compartment of the central area is filled with resilient material.

6. The supporting article according to claim 5, wherein the resilient material in the compartment of the central area is in a compressed state, and the web material defining said central compartment is provided with an opening, which is sealed with a fixed cover.

7. The supporting article according to claim 4, wherein the compartment of the central area is made as an air chamber provided with a valve means.

* * * * *

UNITED STATES PATENT AND TRADEMARK OFFICE

CERTIFICATE OF CORRECTION

PATENT NO. : 6,163,905
DATED : December 26, 2000
INVENTOR(S) : Noldus-Nilsen

It is certified that error appears in the above-identified patent and that said Letters Patent is hereby corrected as shown below:

Title page,
Item [22], please change "May 22, 1998" to -- May 22, 1997 --.
Item [86], please change the § 371 Date from "Nov 20, 1998" to -- January 20, 1999, and please change the § 102(e) date from "Nov. 20, 1998" to -- January 20, 1999 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*